United States Patent [19]

Su

[11] Patent Number: 4,938,392

[45] Date of Patent: Jul. 3, 1990

[54] ANTI-LEAKAGE STRUCTURE FOR A LIQUID ATOMIZER

[76] Inventor: Cheng-Yuan Su, No. 124, Sec. 4, Tung-Ta Road, Hsin-Chu, Taiwan

[21] Appl. No.: 277,270

[22] Filed: Nov. 29, 1988

[51] Int. Cl.[5] ..... B67D 5/42

[52] U.S. Cl. ..... 222/321; 222/375; 222/385; 239/333

[58] Field of Search ..... 222/108, 321, 375, 383, 222/385, 401, 402.2; 239/333

[56] References Cited

U.S. PATENT DOCUMENTS

| | | | |
|---|---|---|---|
| 3,502,035 | 3/1970 | Fedit et al. | 222/321 |
| 4,017,031 | 4/1977 | Kishi et al. | 222/375 |
| 4,082,222 | 4/1978 | Boris | 222/385 |
| 4,113,145 | 9/1978 | Meshberg | 222/321 |
| 4,173,297 | 11/1979 | Pettersen | 222/321 |
| 4,277,001 | 7/1981 | Nozawa | 222/321 |
| 4,305,530 | 12/1981 | Nozawa | 239/333 |
| 4,365,729 | 12/1982 | Saito et al. | 239/333 |
| 4,462,549 | 7/1984 | Saito et al. | 239/333 |
| 4,516,727 | 5/1985 | Saito et al. | 239/333 |
| 4,591,076 | 5/1986 | Iizuka | 239/333 |
| 4,606,979 | 8/1986 | Van Brocklin | 239/333 |
| 4,773,553 | 9/1988 | Van Brocklin | 222/321 |
| 4,776,498 | 10/1988 | Maerte et al. | 222/385 |
| 4,821,928 | 4/1989 | Su | 222/385 |
| 4,823,991 | 4/1989 | Skorka | 222/321 |

*Primary Examiner*—Michael S. Huppert
*Assistant Examiner*—Steven M. Reiss
*Attorney, Agent, or Firm*—Bacon & Thomas

[57] ABSTRACT

Leakage of liquid from a container having an atomizer of the type including a cylinder piston moveably mounted within a ring body and defining an annular air gap therebetween is prevented by providing the upper end of the ring body with an inwardly directed annular flange disposed in sealing and sliding engagement around the piston to prevent escape of fluid from the air gap due to inadvertent movement of the piston. The piston includes either a stepped diameter configuration or a plurality of circumferentially spaced longitudinal grooves which, when encountered by the flange after the piston has been intentionally moved a predetermined distance, permits air to flow through the air gap for dispensing liquid from the atomizer.

4 Claims, 3 Drawing Sheets

ANTI-LEAKAGE STRUCTURE FOR A LIQUID ATOMIZER

BACKGROUND OF THE INVENTION

This invention relates to an improved structure for atomisers, particularly an anti-leakage and reinforcement structure for the atomiser head of a perfume bottle.

Generally speaking, when a conventional atomiser head is being pressed upon, the coordination of the various component members of the atomiser head will be actuated so that the pressure of the liquid which is being compressed inside the compactly sealed space will be stronger than a supporting force generated by the spring member located at the lower end of a movable valve to enable a triangular shaped valve outlet at the top end of the valve body to be separated from the outlet passage to which it is originally kept in close contact, so as to cause the high pressured liquid to be atomised and sprayed out through the forementioned outlet passage. The utilization of a pumping motion for a component member inside the atomiser head enable the perfume to be atomised and sprayed out from the perfume bottle. In this pumping motion, in addition to the compressed liquid, an appropiate quantity of air being pumped into the air cavity will help form and complete the process of the pumping motion. By practical experience, it proves that difficulty will be encountered if the air cannot enter the air cavity i.e. the compression chamber. That is to say, the liquid will be unable to be smoothly sprayed out. Therefore, it is known to preset an inlet is in the atomiser head to speed up the smooth completion of the pumping motion. As indicated in FIGS. 1 and 2, a conventional cylinder piston A includes a first portion A1 which has a rather narrow outer diameter and a longer length and a second portion A2 of greater diameter. There is a corner angle in a slanting direction set at the turning angle where the two different diameter portions adjoined each other. This is commonly known as a triangular shoulder A3. The first portion A1 is mounted inside a hollow sleeve B. The sleeve B includes an internal ring body B1. An appropiate gap C is set in between the internal ring body B1 and the first portion A1, while the bottom end B2 of the internal ring B1 is disposed in engagement with the forementioned triangular shoulder A3. Before the perfume atomiser head is activated, the bottom end B2 of the internal ring B1 is being kept in close engagement with the triangular shoulder A3, so that the interior of the air cavity will be separated from the ambient air. However, once the atomiser head is being pressed down to cause the downward movement of the cylinder piston body A, as indicated FIG. 2, a liquid compression motion will be started and, at the same time, the bottom end of the internal ring body B1 will also be separated from the triangular shoulder A3. Thus, the air will enter the air cavity by passing along gap C which is located in between the internal ring B1 and the first portion A1 to complete the pumping motion. Structures similar to the type having an air inlet preset in the atomiser head are commonly found in the products made in various countries in the world. Therefore, it can be referred to as a conventional prior art. However, as shown in the drawing, it can be seen that the engagement between the bottom end B2 of the internal ring B1 and the triangular shoulder A3 will be easily broken when the atomiser head is being pressed down. For instance, the bottom end B2 of the internal ring body B1 will be caused to separate from the triangular shoulder A3, if the atomiser head is slightly pressed when the perfume package is being squeezed upon at the time when the package is being handled and transported. In this way, the liquid which is being contained in the air cavity will be permitted to leak out through the gap C. Consequently, perfume will be found spreading around the atomiser head when the package is being unpacked. This will not only damage the perfume package, but will also seriously ruin the quality of the perfume and spoil its perfect image of a highly luxurious product.

SUMMARY OF THE INVENTION

It is an object of the present invention to provide a manual, accumulator type atomiser which overcomes the disadvantages described above.

It is a still further object of this invention to provide an atomiser which will, in addition to the anti-leakage measure which is set in between the bottom end of the conventional internal ring body and the triangular shoulder, set a second anti-leakage at the top end of the internal ring body, so as to ensure that the liquid will not leak out under this double assurance.

The above objects and others will become more apparent and understandable by the following detailed description when read in conjunction with the following appended drawings.

DETAILED DESCRIPTION OF THE INVENTION

Figure 1:
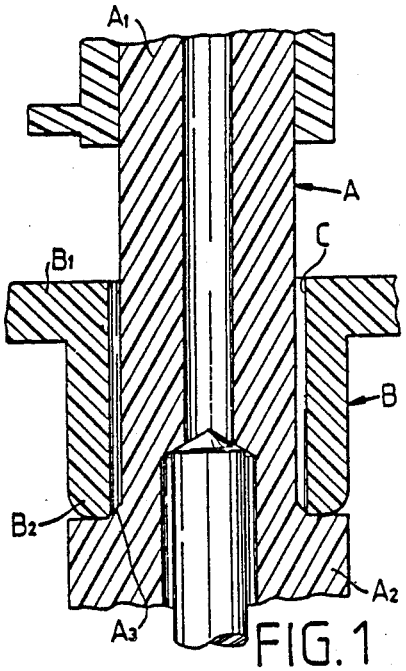
FIG. 1 PRIOR ART
FIG. 1 shows an enlarged partial view of a conventional atomiser in a first position.
Figure 2:
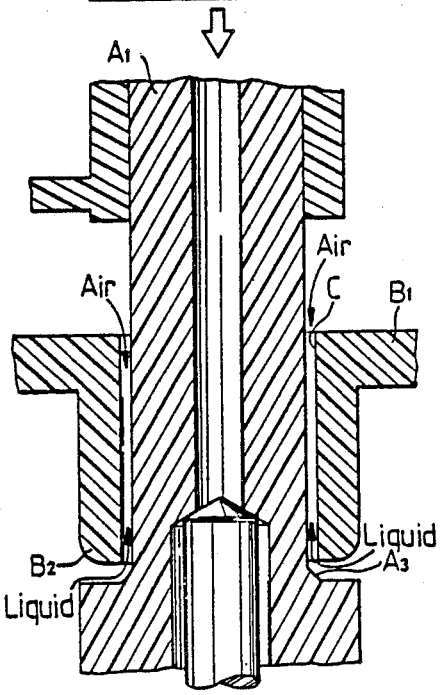
FIG. 2 PRIOR ART
FIG. 2 shows the conventional atomiser of FIG. 1 in a second position.
Figure 3:
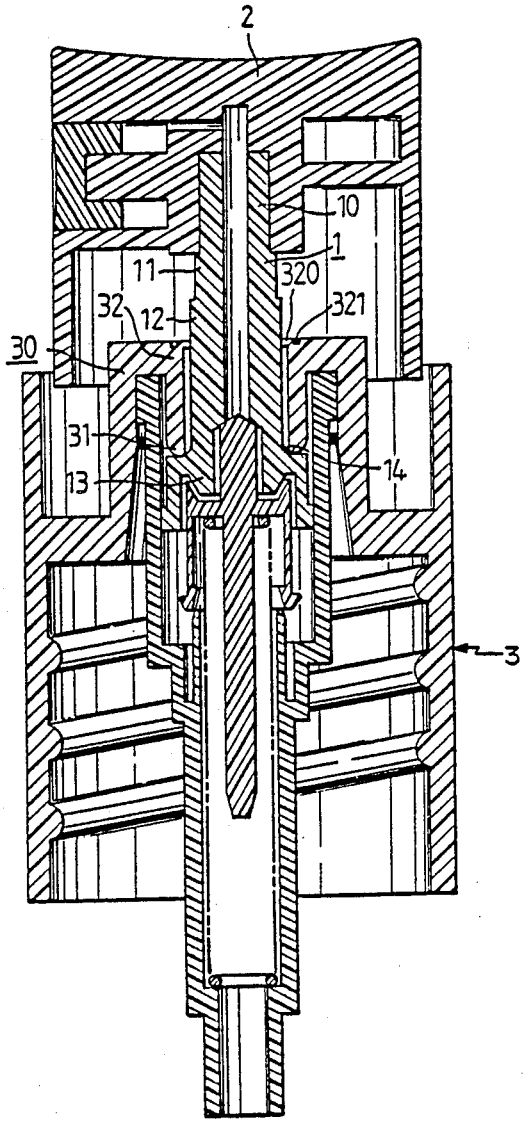
FIG. 3 is a longitudinal sectional elevation of an atomiser according to a first embodiment of the present invention.
Figure 4:
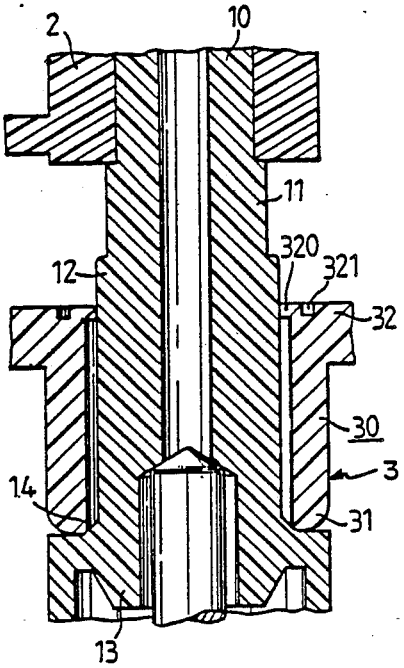
FIG. 4 shows an enlarged partial view of the atomiser of FIG. 3 before the atomiser head has been depressed.
Figure 5:
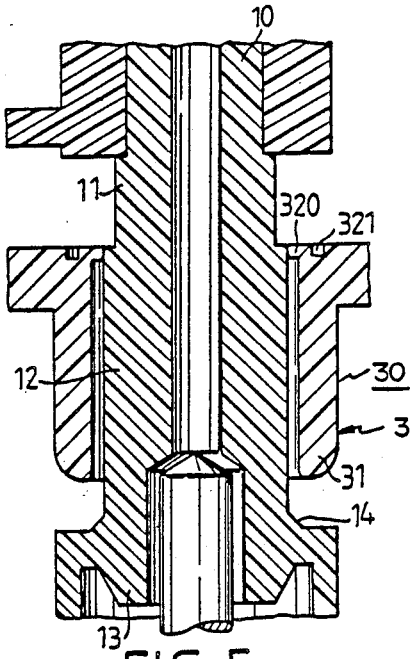
FIG. 5 shows an enlarged partial view of the atomiser of FIG. 3 when the atomiser head begins to be depressed.
Figure 6:
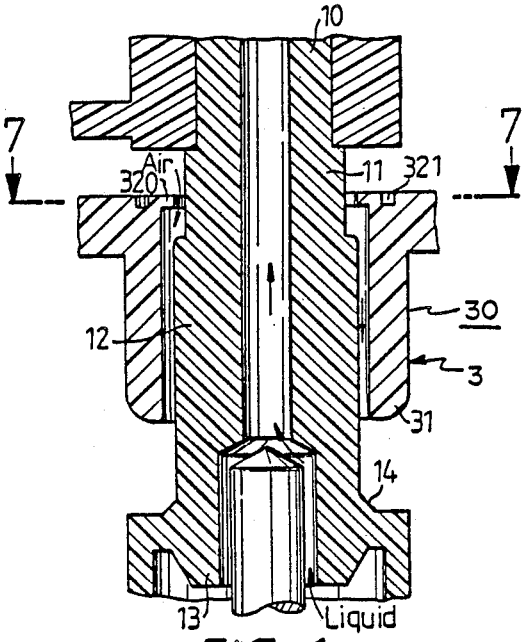
FIG. 6 shows a view similar to that of FIG. 5 but showing the atomiser after the atomiser head has been depressed.
Figure 7:
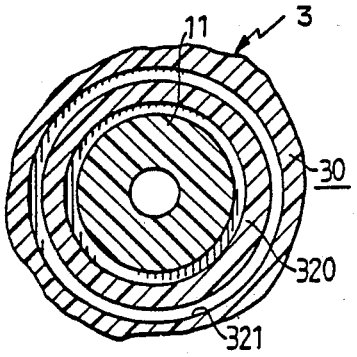
FIG. 7 is a sectional view taken along the section 7—7 of FIG. 6.

Referring to the longitudinal perspective view and the partial enlarged view of FIGS. 3 and FIG. 4 of the present invention, it can be seen that the cylinder piston body 1 includes a ladder-shaped section with four portions of different diameters. Extending respectively downward in increasing diameters, are the first diameter portion 10, which is joined with the body of the atomiser head, the second 11, third 12 and fourth 13 diameter portions. The turning corner where the third 12 and fourth 13 diameter portions adjoined each other is defined by a triangular shoulder 14 in a slanting direction, which is engaged by the lower end 31 of the sleeve 3 of the internal ring body 30. At its upper end, an anti-leakage body 320 in the form of an annular inwardly directed flange, is disposed and dimensioned for engagement against the third diameter portion 12. An annular groove 321 is preset at an appropiate distance at the upper end 32 of the internal ring body 30 and extends in a downward direction, so that the body 320 will, by means of the groove 321 and the elasticity of the plastic material, be disposed in close contact with the third diameter portion 12 and in sealing engagement with the third diameter portion 12. Referring to FIG. 5, it can be seen that, during the entire stroke process, as long as the atomiser head is not separated from the third diameter portion 12 when it is being pressed downward, the contact which exists between the anti-leakage body 320 located at the upper end 32 of the internal ring body 30 and the third diameter portion 12 will be maintained, even though the lower end 31 of the internal ring body 30 has already been separated from its contact with the triangular shoulder 14. In this way, the excellent liquid sealing effect of the anti-leakage structure provided by the invention will still be maintained because of the close contact which is being maintained between the anti-leakage body 320 located at the upper end 32 of the internal ring body 30 and the third diameter portion 12. By the time the atomiser head is pressed downward to cause the piston body 1 to move downward toward the position of the second diameter portion 11 as is shown in FIG. 6 and 7, with sleeve 3 being maintained stationary, the air will then move along the gap in between the body 320 and the second diameter portion 11 until the pressing motion is entirely completed.

From the forementioned description, it is apparent that the main characteristics of the present invention resides in having an anti-leakage body 320 which is provided at the upper end of the internal ring body 30 of the sleeve 3. For the purpose of matching with the elasticity of the body 320, groove 321 is preset at the top plane of the internal ring body 30 adjacent the position where the body 320 is located. A certain number of ladder-shaped diameter portions 10, 11, 12 are provided on a section of the cylinder piston body 1. During the entire pressing process, an appropiate position will be selected as a direction to arrange for the changes to be provided by the different diameter portions. It is so arranged that the air will be unable to enter if the pressing motion does not reach the fixed position. Consequently, the liquid will not be able to flow out of the container. In view of the defects found in the conventional anti-leakage structure which only has a contact maintained between the lower end 31 of the internal ring body 30 and the triangular shoulder 14 as a means of anti-leakage, the present invention provides a second means of anti-leakage, which will overcome such defects.

Figure 9:
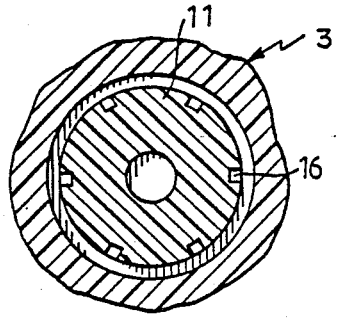
FIG. 9 is a sectional view taken along the section 9—9 of FIG. 8.
Figure 8:
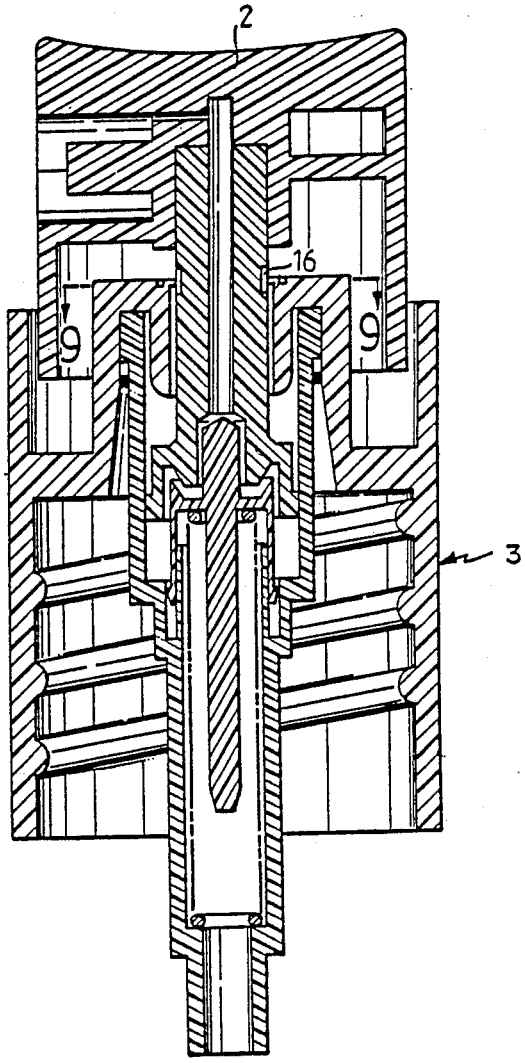
FIG. 8 shows a view similar to that of FIG. 1 but showing a second embodiment of the present invention.

A second embodiment of the invention shall be described with reference to FIGS. 8 and 9. It can be seen in the embodiments that, a certain number of longitudinal grooves 16 of an appropiate length and depth can be provided around the peripheral of the hollow piston body 1. When the grooves 16 are engaged by the anti-leakage body 320, air is permitted to enter the air cavity along the gap, and through grooves 16, so as to achieve the object of the invention.

In summary, this invention makes use of the changes of the different diameter portions of the cylinder piston body 1 or the provision of grooves to correlate with the corresponding position and motion of the sleeve 3 with respect to the triangular shoulder 14, whereby air can enter the air cavity only at the time when the pressing process has reached the fixed position. Correspondingly, even if the lower end 31 of the internal ring body 30 happens to be unexpectedly separated from the triangular shoulder 14, the liquid will still be prevented from flowing out because of the second anti-leakage being formed by the anti-leakage body 320 which is located at the upper end 32 of the internal ring body 30.

What is claimed is:

1. A liquid atomizer of the type including a piston having both an axis and a cylindrical periphery, said piston movable along said axis within a ring body and defining an annular air gap therebetween, the piston having an annular shoulder engageable by a lower edge of the ring body for forming a first seal of the air gap, the improvement comprising the ring body being provided with a second seal means including an inwardly directed annular flange disposed in sealing and sliding engagement around the periphery of the piston and spaced from the first seal to prevent liquid from entering the air gap and leaking out of the atomiser due to breaking of the first seal caused by inadvertent separation of the lower edge of the ring body from the annular shoulder, and air passage means formed on the periphery of the piston, whereby when the flange encounters the air passage means upon axial movement of the piston relative to the ring body over a predetermined operating distance, air is permitted to flow through the air passage means and into the air gap during operation of the atomizer.

2. The liquid atomizer of claim 1 further including an annular groove formed in the ring body and surrounding the annular flange, and wherein the air passage means includes at least one reduced diameter portion on the piston.

3. The liquid atomizer of claim 2 wherein the air passage means includes three reduced diameter portions on the piston.

4. The atomizer of claim 1 further including an annular groove formed in the ring body and surrounding the annular flange, and wherein the air passage means includes a plurality of circumferentially spaced longitudinal grooves.

* * * * *